US005451027A

United States Patent [19]

McHenry

[11] Patent Number: 5,451,027

[45] Date of Patent: Sep. 19, 1995

[54] PICTURE HANGING DEVICE

[76] Inventor: Raymond McHenry, 1402 Mabry Mill Rd., Houston, Tex. 77062

[21] Appl. No.: 202,802

[22] Filed: Feb. 28, 1994

[51] Int. Cl.[6] ..... F16M 13/00

[52] U.S. Cl. ..... 248/544; 248/475.1; 33/613

[58] Field of Search ..... 248/475.1, 542, 544, 248/547, 549; 33/451, 474, 613, 644, 769, 760, 379

[56] References Cited

U.S. PATENT DOCUMENTS 4,228,982 10/1980 Sellera ..... 248/467
4,241,510 12/1980 Radecki ..... 33/180
5,103,573 4/1992 Ethling et al. ..... 33/613
5,103,574 4/1992 Levy ..... 33/760
5,131,164 7/1992 Miller ..... 33/613
5,180,135 1/1993 Hindall ..... 248/544
5,209,449 5/1993 Hart ..... 248/475.1

*Primary Examiner*—Blair M. Johnson
*Assistant Examiner*—Gwendolyn Wrenn

[57] ABSTRACT

A picture hanging device having a top member with a lower linear edge, a bottom member with an upper linear edge in parallel relationship to the lower linear edge of the top member, and a level connected to at least one of the top and bottom members. The top member is slidably connected to the bottom member so as to vary a distance between the linear edges. The level is a bubble level for indicating when the linear edges are extending in a horizontal plane. The upper and lower linear edges are angled from a back side to a front side of the device. The upper linear edge of the bottom member has a plurality of nail-receiving slots formed therein.

18 Claims, 2 Drawing Sheets

PICTURE HANGING DEVICE

TECHNICAL FIELD

The present invention relates to devices that facilitate the hanging of pictures. More particularly, the present invention relates to apparatus that can be used so as to assure that the nails used to hang pictures are in a proper horizontally aligned position.

BACKGROUND ART

Persons often desire to hang pictures on the walls of their dwellings. Pictures can be hung by various techniques. The most common technique employed for the hanging of pictures is to extend a wire across the back side of the picture frame. This wire will extend outwardly from the back of the picture frame so as to engage a pair of nails and/or hooks affixed to the wall upon which the picture is to be hung. This wire will engage the nails and/or hooks so as to rest at a desired location on the wall of the dwelling.

Unfortunately, it is very difficult to install pictures in a proper manner. Often, it is virtually impossible to position the nails and/or hooks in a properly horizontal position. Whenever the nails and/or hooks are out of horizontal alignment, then the picture will hang at a tilt. Often, the nails and/or hooks are installed and replaced several times until the picture is reasonably level.

It is often difficult to place these nails into the wall. Often, a person can find the desired location to install the nail but be unsuccessful in actually nailing the nail into the wall. Often, the nails have an inadequate length to properly grip and hammer. During the course of hammering the nail into the wall, the nail may not reside at a proper upwardly tilted angle. As such, it becomes more difficult to install the framed object on the wall. If the nails do not assume a properly upwardly tilted orientation, then the wire can slide off of the surface of the nail.

Often, when one picture is installed perfectly through the prior art techniques, the installation of a second framed object on the wall becomes more difficult. It is often difficult to properly space and align the second framed object with the first framed object. Furthermore, if several framed items are to be placed on the wall, the spacing of each of the items from an adjacent framed object should be relatively even or symmetrical. This is quite difficult considering the requirements of conventional installation techniques.

In the past, various U.S. patents have issued which describe various devices that can be used to facilitate the installation of pictures and framed objects on a wall. For example, U.S. Pat. No. 5,103,573, issued on Apr. 14, 1992, to Ehling et al. describes a picture hanging device having holes arranged for the purpose of placing nails on both sides. This device includes measuring indicia and a bubble level. A notch is provided so as to allow for a proper centering of the device. Conventional picture hooks are frictionally engaged at predetermined points along the upper edge of the device by a rod which is attached to the device parallel to and spaced apart from the upper edge.

U.S. Pat. No. 5,103,574, issued on Apr. 14, 1992, to K. Levy describes a picture hanging tool having a measuring rule and a slot so as to hold nails and bubble levels. This device employs a mechanism for taking linear measurements between two points on the flat vertical surface. A drawer is provided in the device so as to allow nails to be placed in an easily accessible position. Slots are provided along the ruler so as to receive the nails for the purpose of hanging the picture.

U.S. Pat. No. 4,455,756, issued on Jun. 26, 1984, to G. D. Greene describes a device for hanging pictures which includes an elongated metal member, an opening extending through the member, and a bracket having a ledge portion for supporting a picture hook in the opening in the metal member. Adhesive tape is placed adjacent the opening so as to secure the hook on the elongated member.

U.S. Pat. No. 4,241,510, issued on Dec. 30, 1980, to R. P. Radecki teaches an aid for hanging a picture with a pair of adjustable sliding guides for the placement of nails. This device also employs a bubble level. Slide members are carried on the cross arms to engage a hanging wire. Locating marks on the neck part indicate the top of the picture and are used to position the device at a desired wall location for the picture with the slide members locating the hangers, such as hooks.

It is an object of the present invention to provide a picture hanging device that facilitates the installation of nails and/or hooks into the wall.

It is another object of the present invention to provide a picture hanging device that assures proper horizontal alignment of the nails and/or hooks.

It is a further object of the present invention to provide a picture hanging device that assures that the nails are positioned in a proper upwardly angled manner.

It is still a further object of the present invention to provide a picture hanging device that facilitates the measurement and installation of additional adjacent framed items.

It is still another object of the present invention to provide a picture hanging device that is easy to use, easy to manufacture, and relatively inexpensive.

These and other objects and advantages of the present invention will become apparent from a reading of the attached specification and appended claims.

SUMMARY OF THE INVENTION

The present invention is a picture hanging device that comprises a top member having a lower linear edge, a bottom member having an upper linear edge in parallel relationship to the lower linear edge of the top member, and a bubble level which is connected to at least one of the top and bottom members so as to indicate when the linear edges are in a horizontal orientation. The top member is slidably connected to the bottom member so as to vary a distance between the linear edges.

The lower linear edge is angled from a back side to a front side of the top member. The upper linear edge of the bottom member is also angled in parallel relationship to the lower linear edge. The upper linear edge of the bottom member has a plurality of slots formed therein. The slots extend across the upper linear edge from a front side to a back side of the bottom member. The lower linear edge of the top member also has a plurality of slots extending from a front side to a back side of the top member. The top member also has a top surface. This top surface has a notch formed therein. This notch extends lengthwise across the top edge. The notch is an L-shaped notch extending downwardly from the top surface and opening to a back side of the top member. The bottom member includes a linear scale extending thereacross. This linear scale is arranged in parallel relationship to the upper linear edge of the bottom member. The bubble level is affixed adjacent a top edge of the top member.

In an alternative embodiment of the present invention, the top and bottom members have a plurality of peg members extending transversely outwardly therefrom. At least two of the peg members are aligned vertically and at least two of the peg members are aligned horizontally. These peg members can facilitate the use of a measuring device, such as a yardstick.

DETAILED DESCRIPTION OF THE INVENTION

Figure 1:
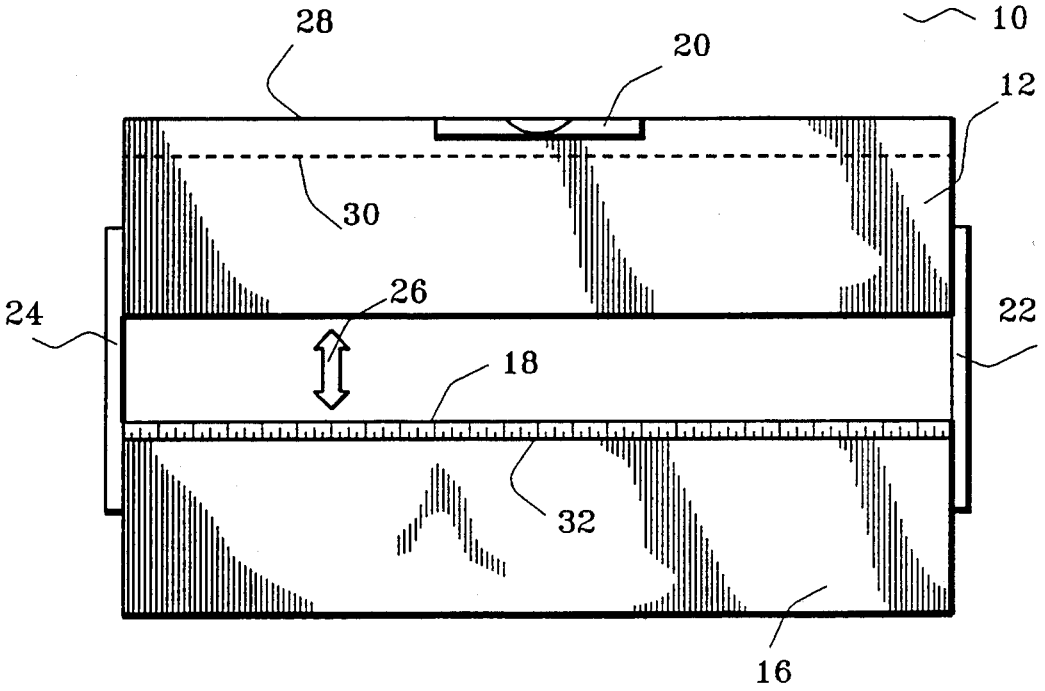
FIG. 1 is a front elevational view of the picture hanging device of the present invention.

Referring to FIG. 1, there is shown at 10 the picture hanging device in accordance with the preferred embodiment of the present invention. The picture hanging device 10 includes a top member 12 having a lower linear edge 14, a bottom member 16 having an upper linear edge 18, and a bubble level 20. As can be seen, the upper linear edge 18 of the bottom member 16 is in parallel relationship to the lower linear edge 14 of the top member 12. The top member 12 is slidably connected by slide sections 22 and 24 to the bottom member 16. The slidable relationship of the top member 12 with the bottom member 16 serves to vary the distance between the linear edges 14 and 18 as indicated by the arrow 26. The bubble level 20 is connected to at least one of the top and bottom members 12 and 16. The bubble level 20 serves to indicate when the linear edges 14 and 16 are horizontal.

In FIG. 1, it can be seen that the top member 12 has a generally rectangular configuration. The linear edge 14 extends across the bottom edge of the top member 12. The top member 12 also includes a top edge 28. The bubble level 20 is affixed adjacent to the top edge 28. As will be described hereinafter, and as illustrated by the broken line in FIG. 1, a slot 30 is formed on the back side of the front surface of the top member 12 at the top edge 28. This slot 30 can serve to receive a yardstick, or similar measuring device, therein.

The top member 12 is connected to the bottom member 16 through slide sections 22 and 24. The slide sections 22 and 24 are affixed to opposite sides of each of the top member 12 and the bottom member 16. The slide sections 22 and 24 can take on a variety of configurations. For example, the slide sections 22 and 24 can be simple rods that serve to hold the members 12 and 16 in alignment and which are received within a slot formed in the sides of members 12 and 16.

The bottom member 16 is also a rectangular member. The bottom member 16 has a configuration somewhat similar to that of the top member 12. The bottom member 16 has its upper linear edge 18 positioned in parallel relationship to the lower linear edge 14 of the top member 12. A linear scale 32 extends lengthwise across the bottom member 16 in Generally parallel relationship to the upper linear edge 18. The scale 32 is a ruler which allows for the proper measurement and placement of nails and/or hooks for the hanging of pictures and other framed items. Although the linear scale 32 is shown as an "inch" ruler, the scale 32 can take on a wide variety of other configurations. The linear scale 32 can be molded into the material of the bottom member 16 or can be imprinted on the surface of the bottom member 16.

In FIG. 1, it can be seen that the lower linear edge 14 of the top member 12 is movable from the position shown in FIG. 1 to a position in which the linear edge 14 is in Juxtaposition with the upper linear edge 18 of the bottom member 16. Movement of the top members 12 with respect to the bottom member 16 is accomplished when nails are placed into the area between the linear edges 14 and 18. As will be described hereinafter, when a nails and/or hook is received within the area between the linear edges 14 and 16, the top member 12 is moved toward the bottom member 16 so that the linear edges 14 and 18 grab and hold the nail therebetween. Once the nail is so positioned, then the hammering activity can be carried out so as to drive the nails into the wall. The bubble level 20 is shown as positioned adjacent to the top edge 28 of the top member 12. It is important to realize that the bubble level 20 can be placed anywhere on the device 10 so as to achieve a proper horizontal alignment. Various other level devices could also be employed, in place of the bubble level 20, so as to assure that the linear edges 14 and 18 reside in horizontal and parallel alignment.

Figure 2:
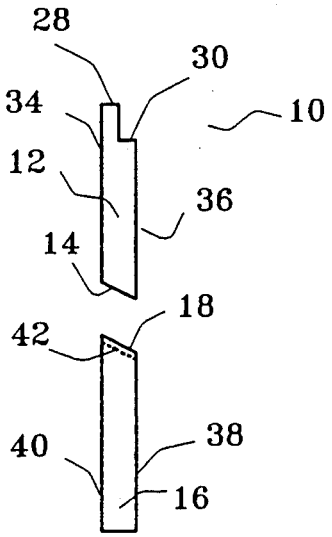
FIG. 2 is a cross-sectional side view of the picture hanging device of the present invention.

FIG. 2 shows the configuration of the picture hanging device 10 through its thickness. In FIG. 2, it can be seen that the lower linear edge 14 of the top member 12 is angled downwardly from the front side 34 to the back side 36 of device 10. Similarly, the upper linear edge 18 of the bottom member 16 is angled in parallel relationship to the linear edge 14. Specifically, the upper linear edge 18 extends upwardly from the back surface 38 of the bottom member 16 toward the front surface 40. The angled arrangement of the linear edges 14 and 18 serves to assure that any nails received therebetween will achieve a proper upwardly angled relationship to the wall upon which the device 10 is placed.

It can be seen in FIG. 2 that the back side of the device 10 is made up of surfaces 36 and 38 which are arranged in vertical alignment. The surfaces 36 and 38 will be placed flush against the surface of the wall onto which it is desired to hang the framed object. As such, during installation activity, the surfaces 36 and 38 will be adjacent a wall. Similarly, the front surfaces 34 and 40 will extend so as to face away from the wall. The top member 12 has a top surface 28 which includes a notch 30 formed therein. The notch 30 extends lengthwise across the top surface 28. This notch 30 has a Generally L-shaped configuration extending downwardly from the top surface 28 and opening to the back side 36 of the top member 12. In use, the notch 30 will receive a yardstick therein. This notch serves to allow the yardstick to be placed in juxtaposition against a wall while being retained in a proper position so as to measure the distance from the installation of one framed object to an adjacent framed object.

In FIG. 2, it can be seen that the upper linear edge 18 of the bottom member 16 includes a slot 42 formed therein. In actuality, and as will be described hereinafter, a plurality of such slots 42 will extend across the length of the linear edge 18. This slot 42 extends across the upper linear edge 18 from the front side 40 to the back side 38 of the bottom member 16. Slot 42 is used so as to receive a nail therein.

Figure 3:
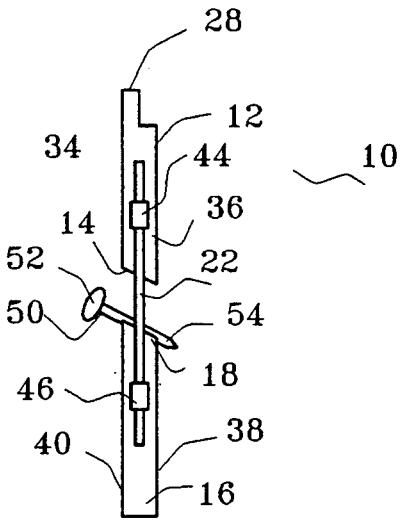
FIG. 3 is an end view of the picture hanging device of the present invention showing a nail received between the linear edges.

FIG. 3 shows the slide section 22 as extending between the top member 12 and the bottom member 16. The slide member 22 includes stops 44 and 46 as to the length of travel between the members 12 and 16. Importantly, in FIG. 3, it can be seen that a nail 50 is positioned within the slots formed on the upper linear edge 18 of the bottom member 16. Nail 50 has a head 52 extending outwardly from the front side 40 of the bottom member 16. The pointed end 54 of the nail 50 is received within the area between the lower linear edge 14 and the upper linear edge 18. In this arrangement, the top member 12 can be pushed downwardly toward the bottom member 16 such that the nail 50 is retained between the lower linear edge 14 and the upper linear edge 18. In this arrangement, it is possible to hammer the head 52 of nail 50 so that the pointed end 54 is driven into a wall at a proper upwardly extending angle.

Figure 4:
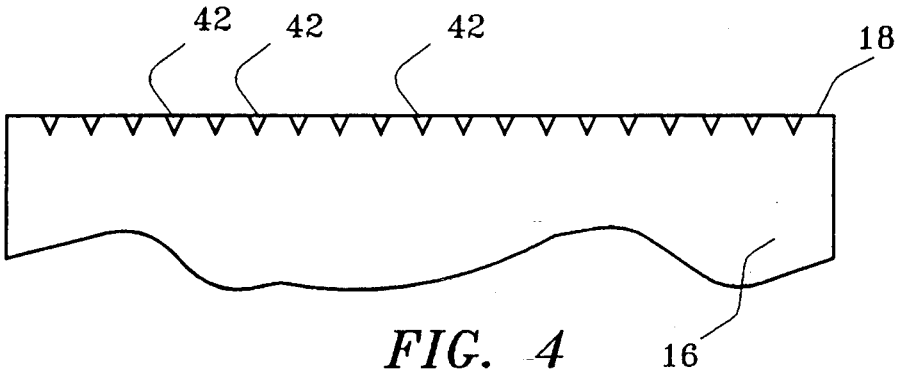
FIG. 4 is an isolated view of a single linear edge of the top and bottom members of the picture hanging device of the present invention.

FIG. 4 is an illustration of the upper linear edge 18 of the bottom member 16. The upper linear edge 18 has a plurality of slots 42 extending thereacross. Each of these slots 42 has a V-shaped configuration. Each of the slots 42 is spaced, at equal intervals, from the adjacent slot 52. In this configuration, the slots 42 will be appropriate for the receipt of the nail therein.

Figure 5:
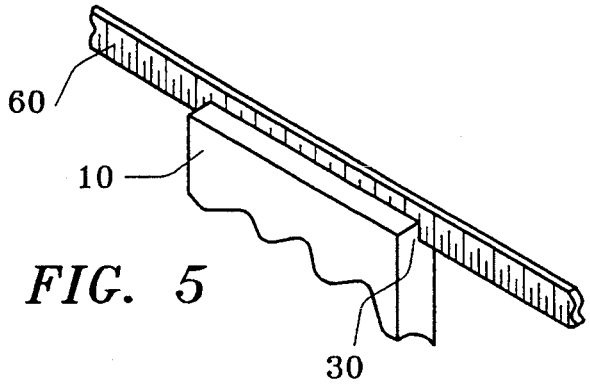
FIG. 5 is an illustration of the picture hanging device of the present invention utilizing a yardstick therein.

FIG. 5 shows the operation of the device 10 for the receipt of a yardstick 60. As can be seen, the yardstick 60 is received within the notch 30 of the device 10. In normal use, the device 10 can be used for the installation of nails and/or hooks for the hanging of pictures. However, after these nails and/or hooks are installed into the wall, it is often necessary to plot and plan where an adjacent picture should be installed. The use of the yardstick 60 allows for proper measurements to be carried out from the point of installation of the original picture. As such, the present invention is adaptable so as to facilitate the installation of not only the original framed object but also additional pictures which are to be placed adjacent to the original framed object.

In the present invention, it is important to realize that when the top member 12 is closed upon the bottom member 16, then the device 10 will remain in position over the nails. As such, the yardstick 60 can be properly placed within the notch 30 in a generally hands-free manner. Proper measurements and markings can be carried out without the need to continue to support the device 10.

Figure 6:
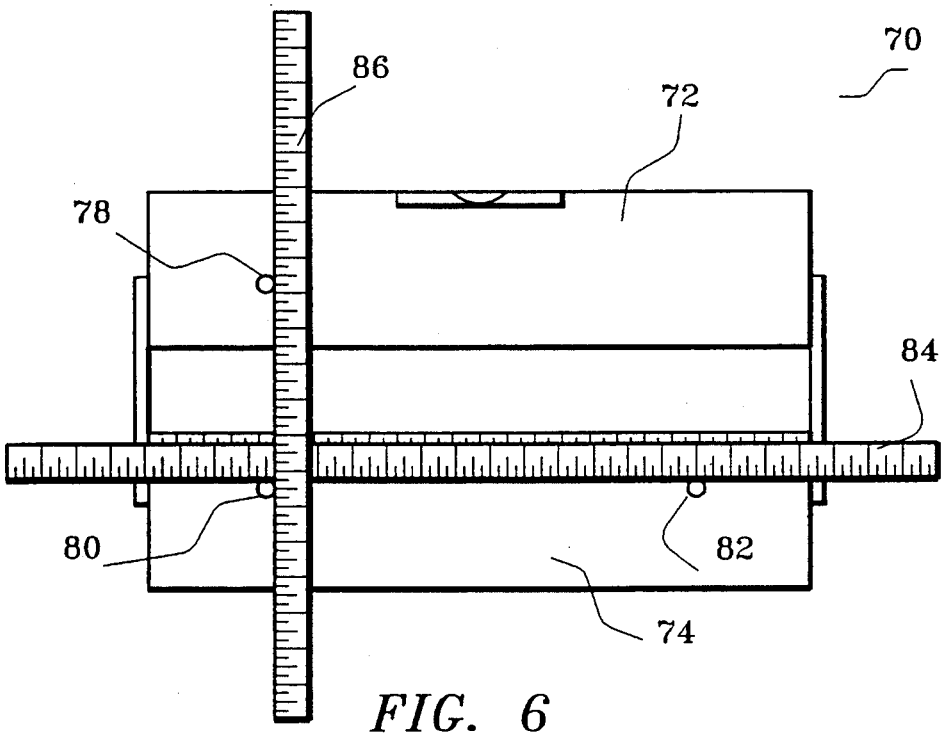
FIG. 6 shows an alternative embodiment of the present invention in which yardsticks are supported by pegs formed on the outer surfaces of the picture hanging device.

FIG. 6 shows an alternative embodiment of the present invention. Specifically, the embodiment 70 includes a top member 72 and a bottom member 74 having a configuration somewhat similar to the previous embodiment. The important difference between the picture hanging device 70 of this alternative embodiment is the elimination of the notch 30 from the top surface 28 of the top member 72. In place of the notch 30, the picture hanging device 70 includes a plurality of pegs 78, 80, and 82. The pegs are placed on the exterior surfaces of the top member 72 and the bottom member 74 and extend outwardly transversely thereto. It is important to realize that at least two of the pegs 80 and 82 are arranged in a generally horizontal relationship. Similarly, two of the pegs 78 and 80 are arranged in vertical alignment. As such, the pegs 80 and 82 will receive a yardstick 84 in a horizontal configuration. Similarly, the pegs 78 and 80 will receive a yardstick 86 in a vertical position. As such, in the embodiment of FIG. 6, vertical and/or horizontal measurements can be made using the yardstick 84 and 86 in conjunction with the pegs 78, 80, and 82.

The foregoing disclosure and description of the invention is illustrative and explanatory thereof. Various changes in the details of the illustrated configurations may be made within the scope of the appended claims without departing from the true spirit of the invention. The present invention should only be limited by the following claims and their legal equivalents.

I claim:

1. A picture hanging device comprising:

a top member having a lower linear edge;

a bottom member having an upper linear edge in parallel relationship to said lower linear edge of said top member, said top member slidably connected to said bottom member so as to vary a distance between said linear edges, at least one of said top member and said bottom member having a linear scale extending thereacross, said linear scale in parallel relation to said upper linear edge of said bottom member; and a level means connected to at least one of said top and bottom members, said level means for indicating when said linear edges are in a desired orientation.

2. The device of claim 1, said lower linear edge being angled from a back side to a front side of said top member, said lower linear edge of said bottom member being angled in parallel relationship thereto.

3. The device of claim 1, said upper linear edge of said bottom member having a plurality of slots formed therein.

4. The device of claim 3, said slots extending across said upper linear edge from a front side to a back side of said bottom member.

5. The device of claim 1, said lower linear edge of said top member having a plurality of slots extending from a front side to a back side of said top member.

6. The device of claim 1, said top member having a top surface, said top surface having a notch formed therein, said notch extending lengthwise across said top surface of said top member.

7. The device of claim 6, said notch being a L-shaped notch extending downwardly from said top surface and opening to a back side of said top member.

8. The device of claim 1, said level means comprising:

a bubble level affixed adjacent a top edge of said top member.

9. The device of claim 1, said top and bottom members having at least a pair of peg members extending transversely outwardly therefrom, said peg members aligned horizontally.

10. The device of claim 1, said top and bottom members having at least a pair of peg members extending transversely outwardly therefrom, said peg members aligned vertically.

11. A picture hanging device comprising:

a top member having a lower linear edge;

a bottom member having an upper linear edge, said top member connected to said bottom member such that a distance between said lower linear edge of said top member and said upper linear edge of said bottom member can be varied, at least one of said linear edges having a plurality of slots formed therein; and a level means connected to at least one of said top and bottom members, said level means for indicating a desired orientation of said linear edges.

12. The device of claim 11, said upper linear edge of said bottom member extending from a front side to a back side of said bottom member at an angle, said slots formed on said upper linear edge, each of said slots having a size and shape suitable for receiving a nail therein.

13. The device of claim 11, said top member and said bottom member slidably connected to each other such that said lower linear edge is movable in parallel relationship to said upper linear edge, said edges movable between a first position and a second position, said first position being in juxtaposition.

14. The device of claim 11, said top member having a top edge, said top edge having a notch formed therein, said notch extending lengthwise across said top member.

15. The device of claim 11, said top and bottom members having a plurality of peg members extending transversely outwardly therefrom, at least two of said peg members aligned vertically and at least two of said peg members aligned horizontally.

16. A picture hanging device comprising:

a top member having a lower linear edge, said top member having a front side and a back side, said lower linear edge angled downwardly from said front side to said back side;

a bottom member having an upper linear edge, said bottom member having a front surface and a back surface, said upper linear edge angled downwardly from said front surface to said back surface, said top member movably connected to said bottom member so as to vary a distance between said upper and lower linear edges, at least one of said upper and lower linear edges having a plurality of nail-receiving slots formed therein, said slots positioned at spaced intervals across said linear edge; and a level means connected to at least one of said top and bottom members, said level means for indicating a desired orientation of said linear edges.

17. The device of claim 16, said upper and lower linear edges in parallel relationship to each other, said desired orientation being horizontal, said linear edges movable between a first position in Juxtaposition to a second position in which said linear edges are distal each other.

18. The device of claim 16, said level means comprising:

a bubble level affixed to said top member in parallel relationship to said lower linear edge of said top member.

* * * * *